US006695509B1

(12) United States Patent
Dowe, Sr.

(10) Patent No.: US 6,695,509 B1
(45) Date of Patent: Feb. 24, 2004

(54) GOLF BALL CLEANING APPARATUS

(76) Inventor: Alfonzo Dowe, Sr., 126 Perkintown Rd., Pedricktown, NJ (US) 08067

( * ) Notice: Subject to any disclaimer, the term of this patent is extended or adjusted under 35 U.S.C. 154(b) by 0 days.

(21) Appl. No.: 10/419,634

(22) Filed: Apr. 21, 2003

(51) Int. Cl.[7] ..... A46B 11/00

(52) U.S. Cl. ..... 401/11; 401/9; 401/283; 401/291; 15/21.2

(58) Field of Search ..... 401/11, 10, 9, 401/283, 291; 15/21.2

(56) References Cited

U.S. PATENT DOCUMENTS

| | | | | | |
|---|---|---|---|---|---|
| 2,608,705 | A | * | 9/1952 | Duff | 401/11 |
| 3,044,089 | A | * | 7/1962 | Boynton | 15/21.2 |
| 3,098,252 | A | * | 7/1963 | Sundquist | 15/104.94 |
| 3,378,873 | A | * | 4/1968 | Strout | 15/244.1 |
| 3,462,230 | A | * | 8/1969 | Beard | 401/11 |
| 5,131,112 | A | | 7/1992 | Cervini | |
| 5,339,486 | A | * | 8/1994 | Persic, Jr. | 15/244.1 |
| D366,685 | S | | 1/1996 | Faulk et al. | |
| 5,641,232 | A | | 6/1997 | Frey | |
| 5,829,086 | A | | 11/1998 | Billek | |
| 6,036,386 | A | | 3/2000 | McDonald | |
| 6,148,464 | A | | 11/2000 | Shioda | |
| 6,379,066 | B1 | | 4/2002 | Gomez | |

* cited by examiner

*Primary Examiner*—David J. Walczak
(74) *Attorney, Agent, or Firm*—John D. Gueliotta; P. Jeff Martin

(57) ABSTRACT

A golf ball cleaning apparatus includes a pair of cylindrical chambers defined as an upper chamber removably attachable to a lower chamber. The lower chamber is provided within an internal golf ball cleaning fluid reservoir bounded upwardly by a lower surface of a semi-porous floor. The lower chamber further includes a half-spherical cavity embedded with semi-rigid scouring bristles. The upper chamber is of a generally hollow configuration and includes a half-spherical cavity embedded with semi-rigid scouring bristles. The semi-rigid scouring bristles snugly engage an entire standard dimpled golf ball surface when the upper and lower chambers are coupled together. The upper chamber is snapped to the lower chamber in a semi-interference-type fit. A fastener is mounted atop the upper chamber to facilitate removable connection of the golf ball cleaning apparatus to a standard golf bag.

9 Claims, 5 Drawing Sheets

GOLF BALL CLEANING APPARATUS

RELATED APPLICATIONS

The present invention was first described in Disclosure Document Registration 514,460 filed on Jul. 9, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to golf ball washing devices and, more particularly, to a portable golf ball cleaning apparatus.

2. Description of the Related Art

Golfers fully understand the importance of playing with clean golf balls. This is particularly important when on the putting surface. Soiled and scuffed golf balls can lead to undesired results on the putting green due to the precise nature and accuracy to which putting requires. In addition, distance and shot trajectory can also be severely compromised when playing with a dirty golf ball. Furthermore, golfers are fully aware that golf balls can become blemished with debris at various times throughout a round of golf. However, a player does not always have access to the use of a ball washer in view of such washers being provided only at particular locations on a course.

Accordingly, a need has arisen for a means by which a golf ball can be washed in a manner which is quick, easy, and efficient. The development of the golf ball cleaning apparatus fulfills this need.

A search of the prior art did not disclose any patents that read directly on the claims of the instant invention; however, the following references were considered related:

| U.S. Pat. No. | Inventor | Issue Date |
|---|---|---|
| 6,379,066 | Gomez | Apr. 30, 2002 |
| 6,148,464 | Shioda | Nov. 21, 2000 |
| 6,036,386 | McDonald | Mar. 14, 2000 |
| 5,829,086 | Billek | Nov. 3, 1998 |
| 5,641,232 | Frey | Jun. 24, 1997 |
| 5,524,311 | Crossley | Jun. 11, 1996 |
| 5,131,112 | Cervini | Jun. 21, 1992 |
| D366,685 | Faulk et al. | Jan. 30, 1996 |

Consequently, a need has been felt for a portable means by which dirt, scuff marks and the like can be effectively removed from a golf ball in a manner which is quick, easy, and efficient.

SUMMARY OF THE INVENTION

Therefore, it is an object of the present invention to provide a portable, lightweight apparatus for washing a golf ball.

It is another object of the present invention to provide a pair of removably attachable cylindrical chambers.

It is another object of the present invention to provide a pair of cylindrical chambers fabricated of a rigid plastic material.

It is another object of the present invention to provide an upper chamber having a half-spherical scouring section which forms a half-spherical cavity embedded with semi-rigid scouring bristles.

It is another object of the present invention to provide a lower chamber having an internal fluid cleaning reservoir integrally formed therein.

It is another object of the present invention to provide a lower chamber with a half-spherical scouring section integrally formed above the internal cleaning fluid reservoir being separated therefrom by a semi-porous floor.

It is another object of the present invention to provide a half-spherical scouring section of the lower chamber which forms a half-spherical cavity embedded with semi-rigid scouring bristles.

It is another object of the present invention to provide the semi-porous floor defined as having a concave shape and which includes a plurality of cleaning fluid seepage apertures formed therein.

It is another object of the present invention to provide an upper chamber having a male raised locking lip for mating with a female lip receiving channel of the lower chamber.

It is another object of the present invention to provide a fastener to facilitate removable connection of the apparatus to the loop of a standard golf bag or to user's belt loop.

Briefly described according to one embodiment of the present invention, a golf ball cleaning apparatus is provided. The apparatus is comprised of a pair of cylindrical chambers defined as an upper chamber removably attachable to a lower chamber.

The lower chamber includes an internal cleaning fluid reservoir bounded upwardly by a lower surface of a semi-porous floor. The internal cleaning fluid reservoir serves as a storage container for golf ball cleaning fluid. A half-spherical scouring section is integrally formed above internal cleaning fluid reservoir and the semi-porous floor includes a plurality of cleaning fluid seepage apertures formed therein and spaced randomly thereabout. The half-spherical scouring section forms a half-spherical cavity embedded with semi-rigid scouring bristles which project outwardly therefrom.

The upper chamber is of a generally hollow configuration and includes a half-spherical scouring section which forms a half-spherical cavity embedded with semi-rigid scouring bristles which project outwardly therefrom. Thus when the upper and lower chambers are coupled together, the semi-rigid scouring bristles of each half-spherical cavity of each respective chamber snugly engage an entire standard dimpled golf ball surface. The upper chamber further includes a male raised locking lip which mates with a female lip-receiving channel of the lower chamber to facilitate a semi-interference-type snap fit in a resilient deformational manner so as to provide removable attachment of upper chamber to lower chamber in a coupled arrangement which allows user to turn each chamber back and forth relative to one another.

A fastener is vertically mounted atop a crown of the upper chamber in order to facilitate removable connection of the golf ball cleaning apparatus to an exposed loop of a standard golf bag or user's belt loop.

The use of the present invention provides an effective means for removing dirt and scuffs from a golf ball which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
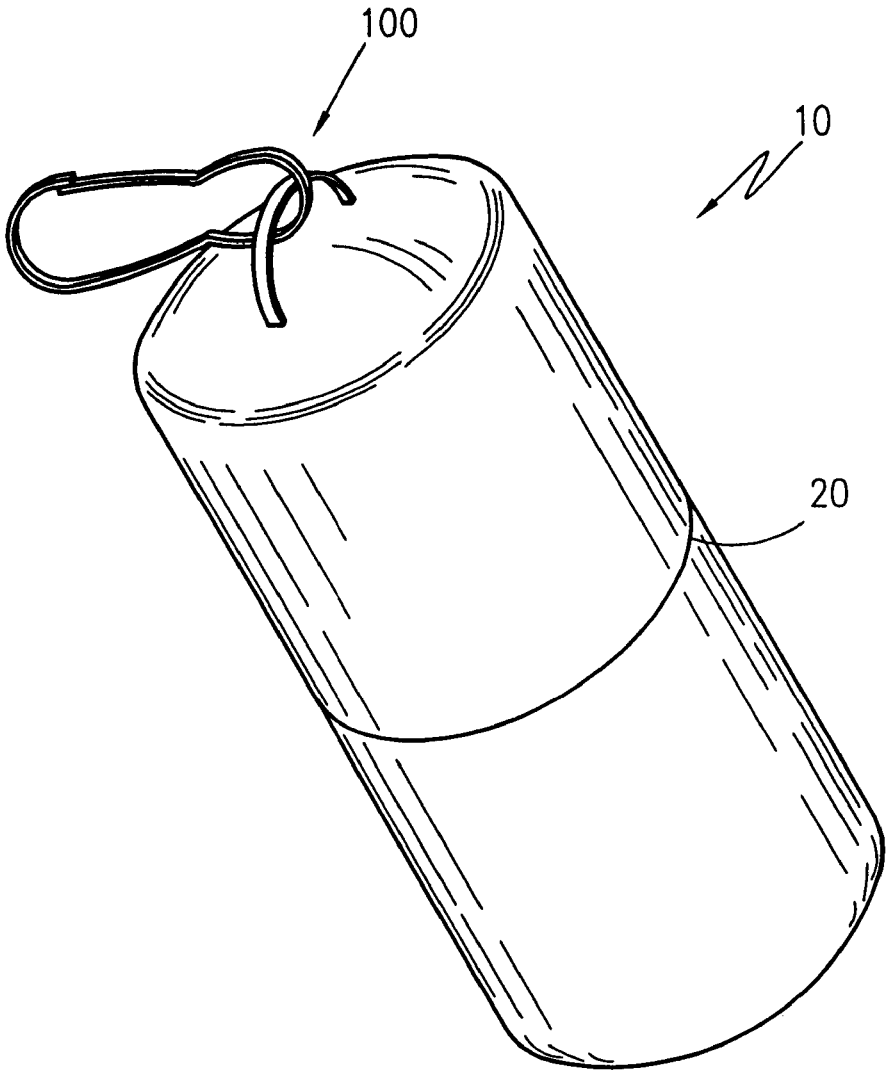
FIG. 1 is a perspective view of the golf ball cleaning apparatus according to the preferred embodiment of the present invention.

Referring now to FIGS. 1–6, a golf ball cleaning apparatus 10 is shown, according to the present invention, comprised of a pair of cylindrical chambers 20 defined as an upper chamber 22 removably attachable to a lower chamber 26. The upper and lower chamber 22, 26 are fabricated preferably of a rigid plastic material.

Referring now to FIGS. 1–4, and 6, the lower chamber 26 includes an internal cleaning fluid reservoir 30 bounded laterally by an interior circumferential sidewall 27 and bounded underneath by a concave bottom wall 28 of lower chamber 26. Reservoir 30 is bounded upwardly by a lower surface of a semi-porous floor 40. The internal cleaning fluid reservoir 30 serves as a storage container for golf ball cleaning fluid 32.

Figure 3:
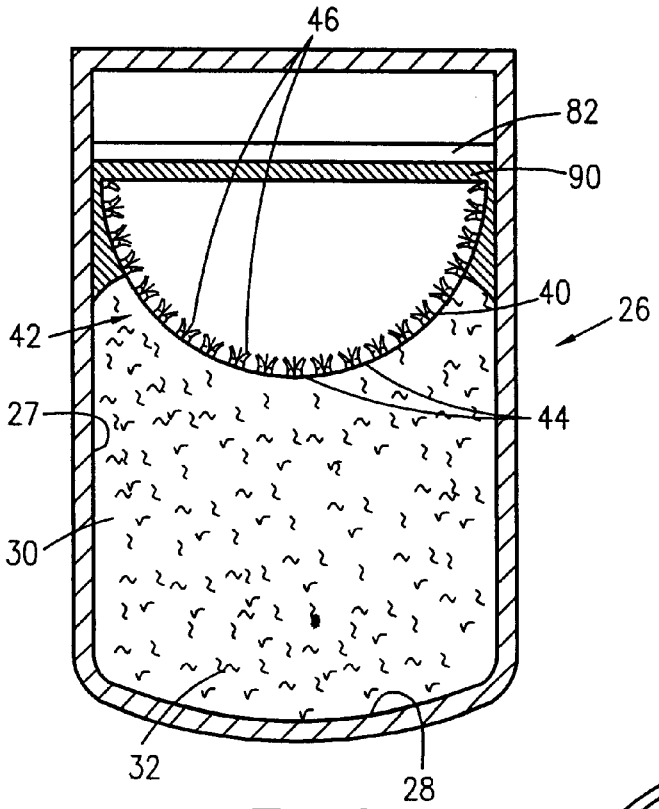
FIG. 3 is a cross-sectional view of the lower chamber according to the preferred embodiment of the present invention.

Referring more specifically to FIG. 3, a first half-spherical scouring section 42 is integrally formed above internal cleaning fluid reservoir 30 and is separated therefrom by its semi-porous floor 40. The semi-porous floor 40 is defined as having a concave shape and includes a plurality of seepage apertures 44 formed therein and spaced randomly thereabout. The seepage apertures 44 facilitate bidirectional passage of golf ball cleaning fluid 32 therethrough via the internal cleaning fluid reservoir 30. Golf ball cleaning fluid 32 is pourably introduced into the internal cleaning fluid reservoir 30 via the first half-spherical scouring section 42 and is withdrawn by inversion of the lower chamber 26, thereby allowing golf ball cleaning fluid 32 to be gravitationally dispelled therefrom.

Figure 7:
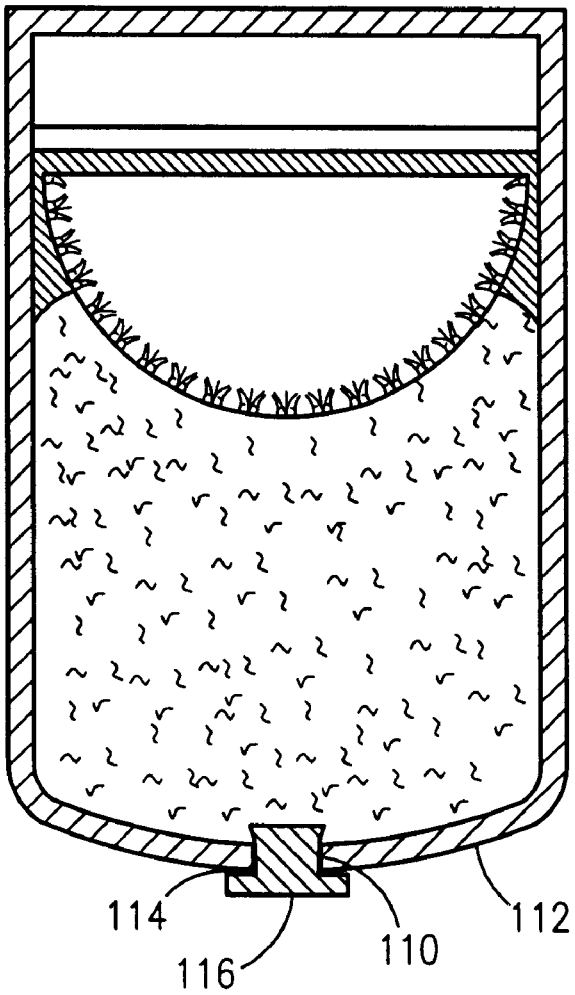
FIG. 7 is a cross-sectional view of an alternate embodiment for the lower chamber.

Referring now to FIG. 7, it is envisioned that a drainage portal 110 may be integrally formed at a vertex 114 of a crown 112 of the lower chamber 26 and extend into the internal cleaning fluid reservoir 30 to facilitate drainage of golf ball cleaning fluid 32 therefrom. A plug 116 is removably inserted within drainage portal 110 and held therein through mechanical impingement to facilitate sealable closure thereof.

Figure 2:
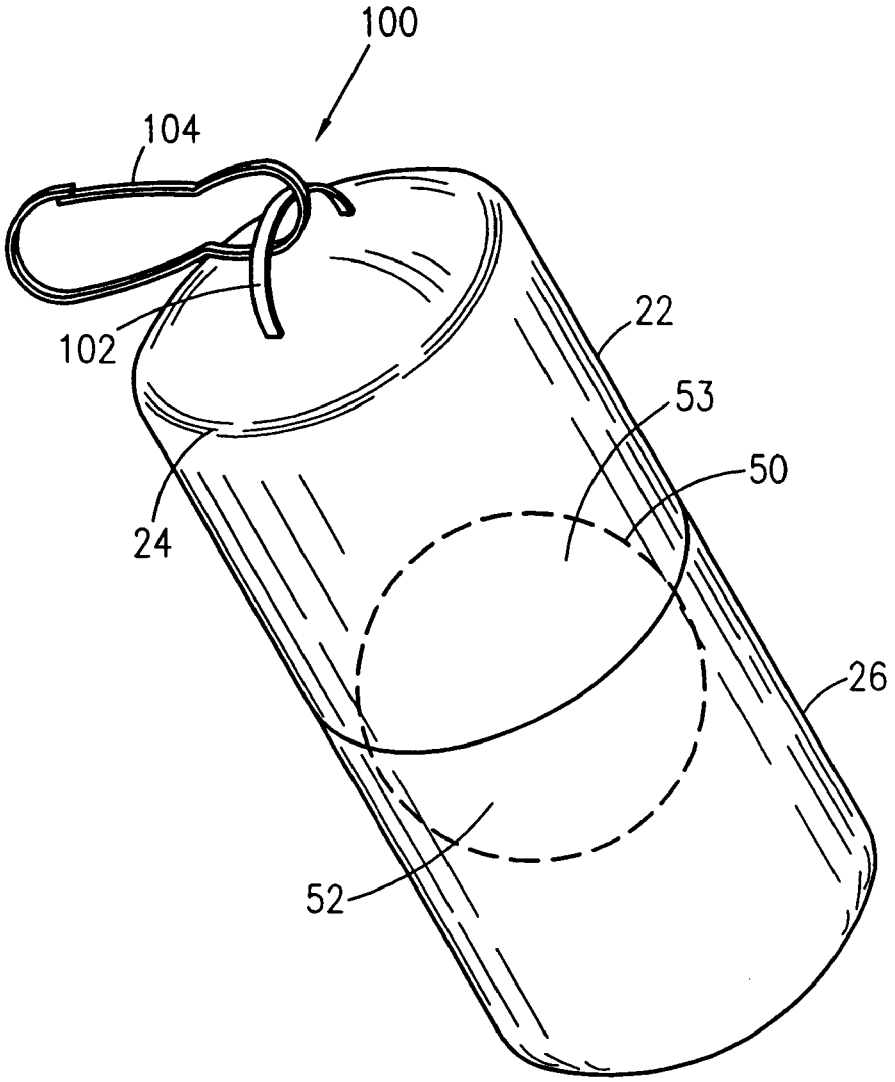
FIG. 2 is a perspective view thereof revealing a standard dimpled golf ball residing snugly therein.
Figure 4:
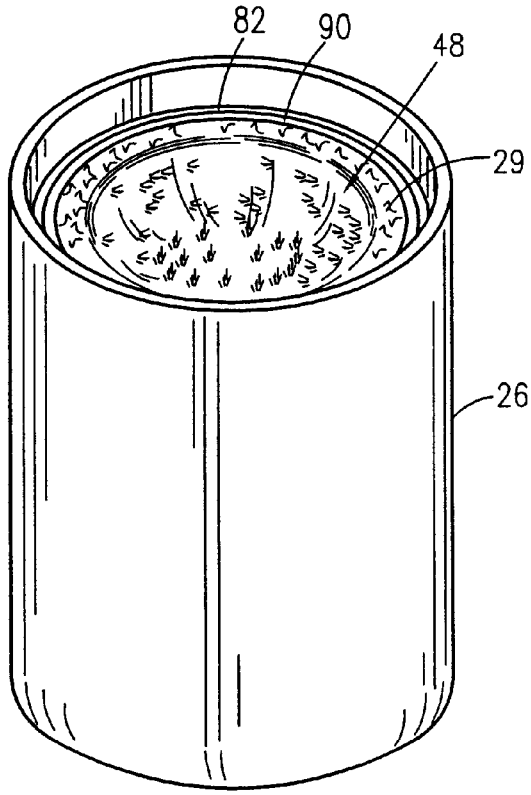
FIG. 4 is a side perspective view of the lower chamber illustrating the half-spherical cavity according to the preferred embodiment of the present invention.
Figure 5:
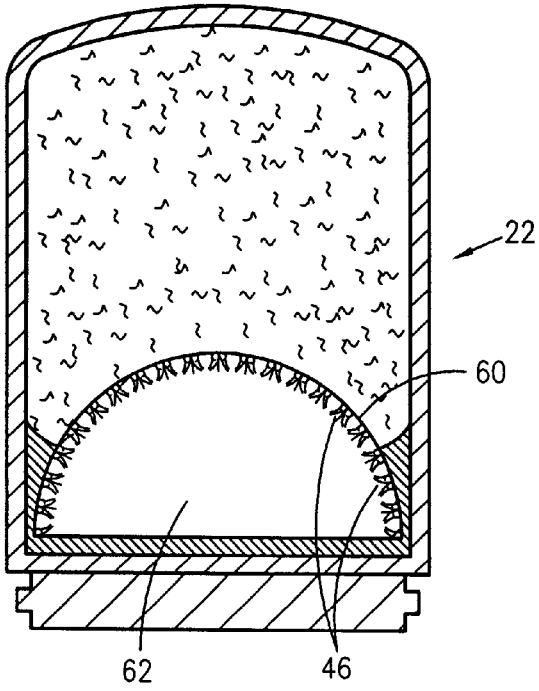
FIG. 5 is a cross-sectional view of the upper chamber according to the preferred embodiment of the present invention.
Figure 6:
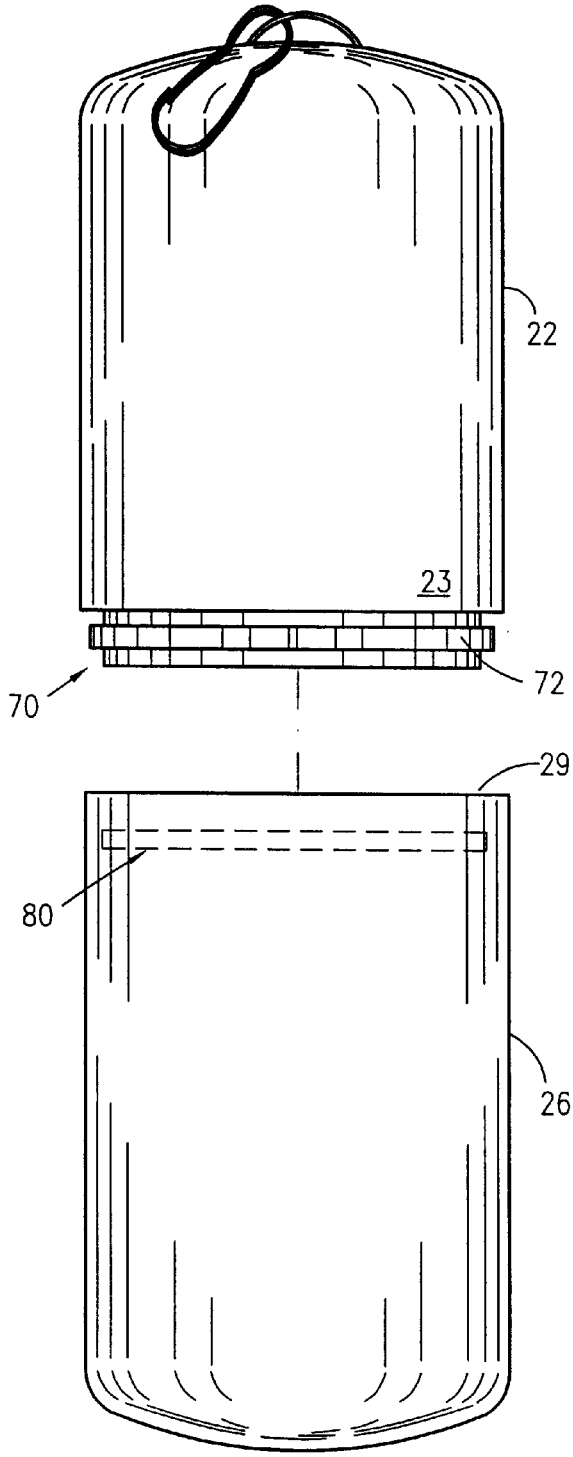
FIG. 6 is an exploded perspective view of the present invention according to the preferred embodiment.

Referring more specifically to FIGS. 2–4, the first half-spherical scouring section 42 forms a half-spherical cavity 48 embedded with semi-rigid scouring bristles 46 which project outwardly therefrom. The semi-rigid scouring bristles 46 are configured to snugly receive and engage a half-spherical surface 52 of a standard dimpled golf ball 50.

Referring now to FIGS. 1–6, the upper chamber 22 is of a generally hollow configuration and includes a second half-spherical scouring section 60 integrally formed just above a male coupling means 70 (to be described in greater detail below). The second half-spherical scouring section 60 forms a half-spherical cavity 62 embedded with semi-rigid scouring bristles 46 which project outwardly therefrom. The semi-rigid scouring bristles 46 are configured to snugly receive and engage a complementary half-spherical surface 53 of the golf ball 50, thus when the upper and lower chambers 22, 26 are coupled together, the semi-rigid scouring bristles 46 of each half-spherical cavity 48, 62 snugly engage an entire standard dimpled golf ball 50 surface.

The male coupling means 70 is of a circular, hollow configuration which integrally projects outwardly and slightly recessed with respect to an outer external circumferential sidewall 23 of the upper chamber 22. The male coupling means 70 further defines a male raised locking lip 72 formed about a periphery thereof for mating with a female lip-receiving channel 82 of a female coupling means 80 of the lower chamber 26. The female lip-receiving channel 82 is integrally formed near an upper open portion 29 of the lower chamber 26 being anterior to its half-spherical scouring section 42.

The male raised locking lip 72 mates with the female lip-receiving channel 82 to facilitate a semi-interference-type snap fit in a resilient deformational manner so as to provide removable attachment of upper chamber 22 to lower chamber 26 in a coupled arrangement which allows user to turn each chamber 22, 26 back and forth relative to one another. Such operation facilitates a scrubbing action by the bristles 46 in combination with seepage of golf ball cleaning fluid 32 through seepage apertures 44 to effectively remove dirt and scuffs from the standard dimpled golf ball 50 surface.

In order to prevent leakage of golf ball cleaning fluid 32 when washing a golf ball 50, a rubber, annular gasket 90 is disposed along an internal circumferential sidewall of the lower chamber 26, just below the female lip-receiving channel 82 thereof. The location of the gasket 90 permits back and forth rotation of the upper and lower chambers 22, 26 relative to one another without impedance while serving as a sealant.

Finally, in order to facilitate removable connection of the golf ball cleaning apparatus 10 to an exposed loop of a standard golf bag or user's belt loop, a fastener 100 is provided. The fastener 100 is defined as having an anchor 102 vertically mounted atop a crown 24 of the upper chamber 22 to which a clip fastener 104 is connected. The clip fastener 104 facilitates removable connection of the golf ball cleaning apparatus 10 to the loop of a standard golf bag or to user's belt loop.

2. Operation of the Preferred Embodiment

To use the present invention, user pours golf ball cleaning fluid 32 into the internal cleaning fluid reservoir 30 of the lower chamber 26, places a standard dimpled golf ball 50 within the first half-spherical cavity 48 of the lower chamber 26 and snaps the upper chamber 22 thereto. User shakes the invention in a rapid back-and-forth motion so as to lubricate the semi-rigid scouring bristles 46. User next turns each chamber 22, 26 back and forth relative to one another thereby facilitating a scrubbing action by the bristles 46 in combination with seepage of golf ball cleaning fluid 32 through seepage apertures 44 to effectively remove dirt and scuffs from the standard dimpled golf ball 50 surface. After washing the golf ball 50, user pulls the chambers 22, 26 apart and removes the clean golf ball 50.

The use of the present invention provides an effective means for removing dirt and scuffs from a golf ball which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A golf ball cleaning apparatus comprising:

a pair of cylindrical chambers, said pair of cylindrical chambers defined by an upper chamber removably attachable to a lower chamber via a male coupling means of said upper chamber and a female coupling means of said lower chamber, and wherein said male coupling means and said female coupling means provide a coupling arrangement which allows user to turn said upper chamber and said lower chamber back and forth relative to one another, wherein said male coupling means is of a circular, hollow configuration which integrally projects outwardly and slightly recessed with respect to an outer external circumferential sidewall of said upper chamber, said male coupling means further defines a male raised locking lip formed about a periphery of said male coupling means for mating with a female lip-receiving channel of said female coupling means of said lower chamber, said female lip-receiving channel is integrally formed near an upper open portion of said lower chamber being anterior to said half-spherical scouring section of said lower chamber, wherein said male raised locking lip mates with said female lip-receiving channel to facilitate a semi-interference-type snap fit in a resilient deformational manner so as to provide removable attachment of said upper chamber to said lower chamber in a coupled arrangement which allows user to turn said lower chamber and said upper chamber back and forth relative to one another;

an internal cleaning fluid reservoir, said internal cleaning fluid reservoir located within said lower chamber, said internal cleaning fluid reservoir serves as a storage container for golf ball cleaning fluid;

a first half-spherical scouring section, said first half-spherical scouring section is integrally formed above said internal cleaning fluid reservoir of said lower chamber;

a second half-spherical scouring section, said second half-spherical scouring section is integrally formed just above said male coupling means; and a fastener, said fastener facilitates removable connection of said golf ball cleaning apparatus to an exposed loop of a standard golf bag or user's belt loop.

2. The golf ball cleaning apparatus of claim 1, wherein said fastener is defined as having an anchor vertically mounted atop a crown of said upper chamber to which a clip fastener is connected, said clip fastener facilitates removable connection of said golf ball cleaning apparatus to the exposed loop of a standard golf bag or to user's belt loop.

3. The golf ball cleaning apparatus of claim 1, further comprising a rubber, annular gasket, said rubber, annular gasket is disposed along an internal circumferential sidewall of said lower chamber, just below said female lip-receiving channel, said rubber, annular gasket prevents leakage of the golf ball cleaning fluid when washing the standard dimpled golf ball, and wherein said rubber, annular gasket is disposed in a location which permits back and forth rotation of said upper chamber and said lower chamber relative to one another without impedance while serving as a sealant.

4. The golf ball cleaning apparatus of claim 3, further comprising a drainage portal integrally formed at a vertex of a crown of said lower chamber, said drainage portal extends into said internal cleaning fluid reservoir to facilitate drainage of golf ball cleaning fluid therefrom, wherein said drainage portal has a plug removably inserted therein to facilitate sealable closure of said drainage portal, and wherein plug is held within said drainage portal through mechanical impingement.

5. The golf ball cleaning apparatus of claim 1, wherein said upper chamber is of a generally hollow configuration.

6. The golf ball cleaning apparatus of claim 1, wherein said internal cleaning fluid reservoir is bounded laterally by an interior circumferential sidewall, bounded underneath by a concave bottom wall of said lower chamber, and bounded upwardly by a lower surface of a semi-porous floor.

7. The golf ball cleaning apparatus of claim 5, wherein said first half-spherical scouring section is separated from said internal cleaning fluid reservoir by said semi-porous floor of said first half-spherical scouring section, wherein said semi-porous floor is defined as having a concave shape and includes a plurality of seepage apertures formed therein and spaced randomly thereabout, said seepage apertures facilitate bidirectional passage therethrough of the golf ball cleaning fluid via said internal cleaning fluid reservoir.

8. The golf ball cleaning apparatus of claim 7, wherein said first half-spherical scouring section forms a half-spherical cavity embedded with semi-rigid scouring bristles which project outwardly therefrom, said semi-rigid scouring bristles are configured to snugly receive and engage a half-spherical surface of a standard dimpled golf ball.

9. The golf ball cleaning apparatus of claim 8, wherein said second half-spherical scouring section forms a half-spherical cavity embedded with semi-rigid scouring bristles which project outwardly therefrom, said semi-rigid scouring bristles are configured to snugly receive and engage a complementary half-spherical surface of the standard dimpled golf ball, thus when said upper chamber and said lower chamber are coupled together, said semi-rigid scouring bristles of said half-spherical cavity of said first half-spherical scouring section and said semi-rigid scouring bristles of said half-spherical cavity of said second half-spherical scouring section snugly engage an entire standard dimpled golf ball surface.

* * * * *